US009234410B2

(12) United States Patent
Lemetayer

(10) Patent No.: US 9,234,410 B2
(45) Date of Patent: Jan. 12, 2016

(54) METHOD FOR CONTROLLING A HYDROCARBONS PRODUCTION INSTALLATION

(75) Inventor: Pierre Lemetayer, Pau (FR)

(73) Assignee: TOTAL S.A., Courbevoie (FR)

( * ) Notice: Subject to any disclaimer, the term of this patent is extended or adjusted under 35 U.S.C. 154(b) by 780 days.

(21) Appl. No.: 12/705,535

(22) Filed: Feb. 12, 2010

(65) Prior Publication Data

US 2010/0288506 A1 Nov. 18, 2010

(30) Foreign Application Priority Data

Feb. 13, 2009 (FR) ..... 09 00658

(51) Int. Cl.
*E21B 43/12* (2006.01)
*E21B 43/00* (2006.01)

(52) U.S. Cl.
CPC ..... *E21B 43/122* (2013.01); *E21B 43/00* (2013.01); *E21B 43/12* (2013.01)

(58) Field of Classification Search
CPC ..... E21B 4/066; E21B 34/06; E21B 34/16; E21B 43/12; E21B 43/122
USPC ..... 166/250.15, 369, 373, 306, 372, 53
See application file for complete search history.

(56) References Cited

U.S. PATENT DOCUMENTS

| | | | | |
|---|---|---|---|---|
| 3,362,347 | A * | 1/1968 | Canalizo | 417/117 |
| 5,132,904 | A * | 7/1992 | Lamp | 700/282 |
| 5,146,991 | A * | 9/1992 | Rogers, Jr. | 166/369 |
| 5,413,175 | A | 5/1995 | Edmunds | |
| 5,878,817 | A * | 3/1999 | Stastka | 166/372 |
| 6,196,324 | B1 * | 3/2001 | Giacomino et al. | 166/372 |
| 6,293,341 | B1 | 9/2001 | Lemetayer | |
| 6,595,294 | B1 * | 7/2003 | Dalsmo et al. | 166/369 |
| 6,668,943 | B1 * | 12/2003 | Maus et al. | 175/5 |
| 7,672,825 | B2 * | 3/2010 | Brouwer et al. | 703/10 |
| 2006/0041392 | A1 | 2/2006 | Havre | |
| 2008/0041586 | A1 * | 2/2008 | Eken | 166/250.15 |

(Continued)

FOREIGN PATENT DOCUMENTS

| | | | |
|---|---|---|---|
| EP | 0756065 | A1 | 1/1997 |
| FR | 2783557 | A1 | 3/2000 |
| WO | WO 00/75477 | A1 | 12/2000 |
| WO | WO 2006/067151 | A1 | 6/2006 |

OTHER PUBLICATIONS

Wang, "Development and Applications of Produciton Optimization Techniques for Petroleum Fields," Mar. 2003, Stanford University.*

(Continued)

*Primary Examiner* — Elizabeth Gitlin
(74) *Attorney, Agent, or Firm* — Adeli LLP

(57) ABSTRACT

For controlling a hydrocarbons production installation, comprising at least one hydrocarbons production string activated by a gas injection using a gas injection choke, and a production choke on the string, a method comprises a production phase during which the position of at least one of the chokes is adjusted by cascaded control loops. The loops are driven according to continuously or sequentially developing setpoint parameters. The installation can be controlled more accurately and quickly than in the prior art, as a cascade control loop architecture makes it possible to simplify each of the loops in order to increase the speed of implementation, while still taking account of a greater number of setpoint parameters.

13 Claims, 4 Drawing Sheets

(56) References Cited

U.S. PATENT DOCUMENTS

| | | | | |
|---|---|---|---|---|
| 2008/0156486 | A1* | 7/2008 | Ciglenec et al. | 166/264 |
| 2008/0262736 | A1* | 10/2008 | Thigpen et al. | 702/9 |
| 2008/0262737 | A1* | 10/2008 | Thigpen et al. | 702/9 |
| 2009/0173390 | A1* | 7/2009 | Slupphaug et al. | 137/12 |
| 2010/0206560 | A1* | 8/2010 | Atencio | 166/250.15 |

OTHER PUBLICATIONS

Frohne, "Large Scale Foam Fracturing in the Devonian Shale—A Field Demonstration in West Virginia," Apr. 1977, Energy Research and Development Administration.*

Eikrem, Gisle Otto, et al., "Stabilization of Gas Lifted Wells Based on State Estimation", IFAC, 2004 (Month N/A), pp. 1-6.

Jansen, Bard, et al., "SPE 56832 Automatic Control of Unstable Gas Lifted Wells", 1999 SPE Annual Technical Conference and Exhibition, Oct. 1999, pp. 1-9, Houston, Texas.

Storkaas, Espen, et al., "Cascade control of unstable systems with application to stabilization of slug flow", IFAC—Symposium Adchem' 2003, Jan. 2004, pp. 1-6, Hong Kong.

* cited by examiner

METHOD FOR CONTROLLING A HYDROCARBONS PRODUCTION INSTALLATION

BACKGROUND OF THE INVENTION

The present invention relates to a method for controlling a hydrocarbons production installation. The method is applied to an installation comprising one or more hydrocarbons production strings.

Document FR 2 783 557 relates to a method for controlling a liquid and gaseous hydrocarbons production well activated by gas injection. The well comprises at least one production string equipped with an outlet choke with an adjustable or variable aperture. Pressurized gas, the flow rate of which is adjustable using a control valve, is injected into the annular string. The method comprises a start-up phase that consists of carrying out the following series of steps:

a step of initiating the hydrocarbons production, a step of ramping up to production speed, followed by a production phase. During these phases, the outlet choke of the production string concerned (if the installation comprises several strings, the various chokes are operated) and the control valve are operated in order to maintain the stability of the flow rate of the hydrocarbons produced.

Said document describes a sequential control operation of the well valves. The drawback of such a sequential operation is the difficulty of adapting to the instabilities of the well, resulting in an undesirable variation in the liquid flow rate or gaseous flow rate at the wellhead. Such instabilities prolong the start-up time of the well. Furthermore, a drawback of the operation described in said document is that certain phases of the operation are governed by too long a time lag, which delays the production phase.

Document EP 0 756 065 describes a system for controlling the hydrocarbons production using a production string that extends into a production well. Gas is injected at the bottom of the string. The system comprises a choke with a variable or adjustable aperture for adjusting the flow of hydrocarbons in the production string and comprises a control module for dynamically controlling the choke aperture. The system described is a dynamic choke aperture adjustment system, but the drawback of such a system is that the start-up of the well is not carried out under optimum conditions. In particular, the system described does not allow appropriate management of the occurrence of hydrocarbons plugs at the well start-up. In effect, a system operating solely continuously does not allow free action on the gas production and injection chokes to allow plugs to be expelled. Similarly, if such a continuous system drifts, it is not possible to make good by a stabilizing mode of operation.

Document U.S. Pat. No. 6,595,294 describes a method for controlling the production flow rate of a well. The well comprises a production string with at least one production choke and gas injection means comprising at least one gas injection choke. At least one of the chokes is controlled continuously using a model-based control system. The system comprises a stabilization controller based on a dynamic return of at least one of the elements chosen from a measurement of pressure, temperatures or flow rates in the well. These pressures, temperatures and flow rates are effectively stabilized by the model-based control system at specified operation points, even if the specified operation point is unstable in an open loop. The operation described is a dynamic adjustment operation but is based on the use of a mathematical model.

However, an operation based on the use of a model has drawbacks. One drawback is that it is difficult for a model to take account of the temperature of the valves at the moment of start-up. This temperature has an effect on the manner of start-up of the well. Also, a further drawback is that it is difficult for a model to take account of the state of the fluids around the well, which are unpredictable. These drawbacks thus do not allow start-up of the well under conditions as close as possible to the actual well conditions.

The document *Automatic Control of Unstable Gas Lifted Wells* (SPE 56832, by Bard, Lemetayer et al, 1999) describes methods centred on manipulation of the production and gas injection valves. In this article, the methods are described as alternatives and are the methods forming the subjects of patents U.S. Pat. No. 6,595,294 and FR 2 783 557.

Other methods are disclosed in documents WO 2006/067151, WO 00/75477, U.S. Pat. No. 5,413,175, US 2006/041392, "Cascade control of unstable systems with application to stabilization of slug flow" by Espen Storkaas and Sigurd Skogestad (IFAC-SYMPOSIUM ADCHEM), and "Stabilization of gas lifted wells based on state estimation" by Gisle Otto Eikrem et al. (IFAC), the contents of each of which are hereby incorporated by reference. While these prior art methods have achieved a varying degree of success, the art is constantly in need of a method for controlling a hydrocarbons production installation that solves all or some of the above problems.

SUMMARY OF THE INVENTION

To this end, the invention proposes a method for controlling a hydrocarbons production installation, the latter comprising:

at least one hydrocarbons production string activated by a gas injection using a gas injection choke, and a production choke on the string, the method comprising a production phase during which the position of at least one of the chokes is adjusted by cascaded control loops, the loops being driven according to continuously or sequentially developing setpoint parameters.

According to a variant, during the production phase, the position of the production choke is adjusted by cascaded control loops, the loops being driven according to continuously or sequentially developing setpoint parameters.

According to a variant, the position of the production choke is continuously adjusted by the control loops.

According to a variant, during the production phase, the position of the gas injection choke is continuously adjusted by cascaded control loops, the loops being driven according to continuously or sequentially developing setpoint parameters.

According to a variant, the method comprises, prior to the production phase, a start-up phase during which:

the position of the production choke is sequentially adjusted and the position of the gas injection choke is continuously adjusted by a control loop driven according to continuously or sequentially developing setpoint parameters.

According to a variant, the loops are also driven according to parameters measured on the installation or calculated.

According to a variant, the parameters are chosen from a group comprising in particular the pressure at the head of the production string, the pressure in the production string, the pressure at the top of the injection string, the flow rate of the gas injected by the gas injection choke, the gas flow rate at the gas injection point into the production string.

According to a variant, the position of the production string is adjusted by the control loops also according to a final setpoint aperture of the production string or according to a setpoint aperture of the production choke that increases sequentially.

According to a variant, the method comprises a loop for the continuous adjustment of the setpoint pressure in the production string according to the measured aperture of the production choke and a reference aperture of the production choke.

According to a variant, the method comprises a loop for the continuous adjustment of the setpoint pressure at the string head according to the setpoint pressure in the production string and a pressure in the production string obtained by calculation or by measurement.

According to a variant, the method comprises a loop for the continuous adjustment of the production choke aperture according to the setpoint pressure at the string head and according to the measured pressure at the string head.

According to a variant, the method comprises a loop for the adjustment of a reference gas flow rate according to the setpoint pressure at the gas injection point into the production string and a pressure in the string obtained by calculation or by measurement.

According to a variant, the method comprises a loop for the continuous adjustment of the gas injection choke aperture according to the reference gas flow rate and according to the setpoint gas flow rate.

According to a variant, the position of the gas injection choke is adjusted by the control loops also according to a setpoint gas flow rate at the point of gas injection into the production string, the setpoint gas flow rate at the gas injection point in the production string increasing sequentially.

According to a variant, the method comprises a loop for the continuous adjustment of the gas injection choke aperture according to a setpoint gas flow rate and according to the gas flow rate measured or calculated at the point of gas injection into the production string.

According to a variant, the method also comprises a loop for the adjustment of the maximum setpoint aperture of the production choke according to a pressure measured downstream of the production choke and a reference pressure downstream of the production choke.

According to a variant, the hydrocarbons production choke is open according to the smallest aperture between the maximum setpoint aperture and the previously obtained aperture.

According to a variant, the installation comprises a plurality of strings.

Further characteristics and advantages of the invention will become apparent on reading the following detailed description of the embodiments of the invention, given by way of example only and with reference to the drawings.

DETAILED DESCRIPTION OF PREFERRED EMBODIMENTS

The invention relates to a method for controlling a hydrocarbons production installation. The installation comprises at least one hydrocarbons production string activated by a gas injection using a gas injection choke, and a production choke on the string. The method comprises notably a production phase during which the position of at least one of the chokes is adjusted by cascaded control loops. The loops are driven according to continuously or sequentially developing setpoint parameters. The invention makes it possible to control the installation more accurately and quickly than in the prior art, as a cascade control loop architecture makes it possible to simplify each of the loops in order to increase the speed of implementation, while still taking account of a greater number of setpoint parameters.

Figure 1:
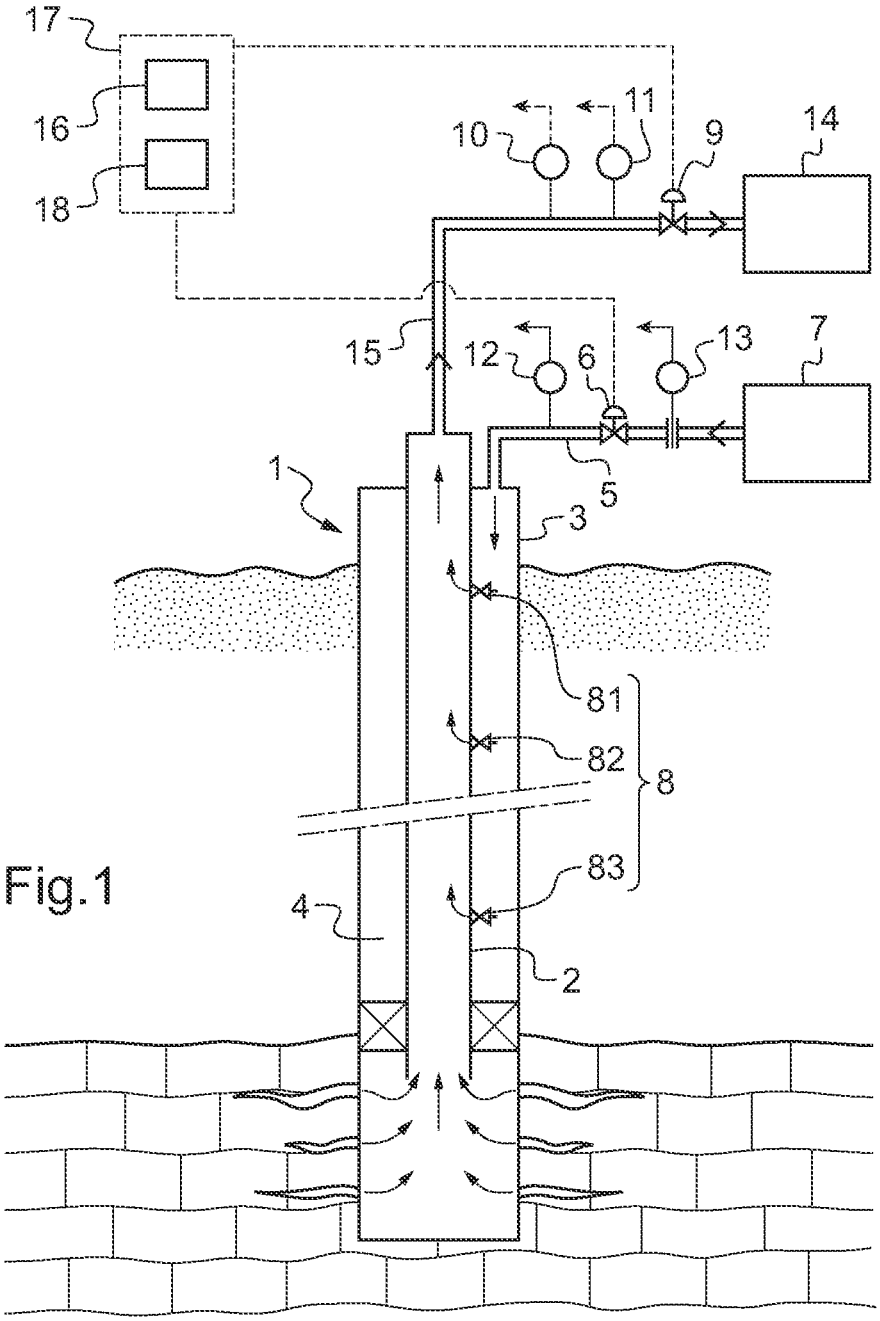
FIG. 1 shows a diagrammatic representation of a production installation.

FIG. 1 shows a hydrocarbons production installation. According to FIG. 1, the installation allows production on a hydrocarbons well (oil and gas). Application to a well will be described, non-limitatively, below. In effect, the application to a well is given by way of example as the description of the production control can be applied to a string linking a wellhead on the sea bed and a platform above sea-level.

The well is activated by gas injection from a pressurized gas source. The well 1 supplies hydrocarbons treatment units downstream. The well comprises at least one production string 2 (or "tubing"). The installation can comprise more than one string. A lining 3 surrounds the string 2. At the foot of the lining 3, apertures allow hydrocarbons to pass from the earth to the string 2. A space 4 (or "casing") is defined between the string 2 and the lining 3. This space 4 is annular around the string 2. The space 4 is plugged using a "packer". This makes it possible to isolate the space 4 from the bottom of the lining 3. Thus, the hydrocarbons are channelled towards the inside of the string 2. It can also be envisaged that the space 4 is not plugged, or that the gases are conveyed by a dedicated closed tube.

FIG. 1 also shows an exit pipe 15 of the hydrocarbons produced. The exit pipe 15 links the upper part of the string 2 to downstream treatment units 14. A hydrocarbons production choke 9 can be provided on the exit pipe 15 to control the hydrocarbons flow rate. This choke is a calibrated orifice allowing the flow rate of the well to be adjusted. The choke 9 has an adjustable aperture. A sensor 10 for measuring the temperature upstream of the choke 9 delivers an electronic signal representing the temperature upstream of the choke 9. Also, a pressure sensor 11 upstream of the choke 9 delivers an electronic signal representing the pressure upstream of the choke 9.

A pressurized gas source 7 allows the space 4 to be supplied. The string 2 comprises a plurality of valves 8 (81, 82, 83 by way of example) for gas to enter the string 2 from the space 4. These valves correspond to gas injection points into the string. These points can be at different heights or levels with respect to the string head. A flow line 5 allows the injection of gas into the space 4 from the gas source 7. A choke 6 allows the flow rate of injected gas to be controlled. A pressure sensor 12 downstream of the choke 6 delivers an electronic signal representing the pressure downstream of this choke 6. Also, a sensor 13 of the injected gas flow rate, located upstream of the choke 6, delivers an electronic signal representing the flow rate of injected gas.

A logic controller 17 comprises a programmable module 16. The logic controller 17, and in particular the module 16, delivers signals controlling the production choke 9 and the gas injection choke 6. The module 16 can comprise a memory previously loaded with a control program and useful data for controlling production, in particular all the predetermined values for the adjustment variables. The module 16 also provides the closed-loop control of the injected gas flow rate by acting on the valve 6 according to the signals delivered by sensors 10, 11, 12 and 13.

The logic controller 17 also comprises a production control module 18. The module 18 allows the cascaded corrections, described below, to be carried out on the production 9 and injection 6 chokes based on values that are measured or calculated at the surface and at the bottom.

Figure 2:
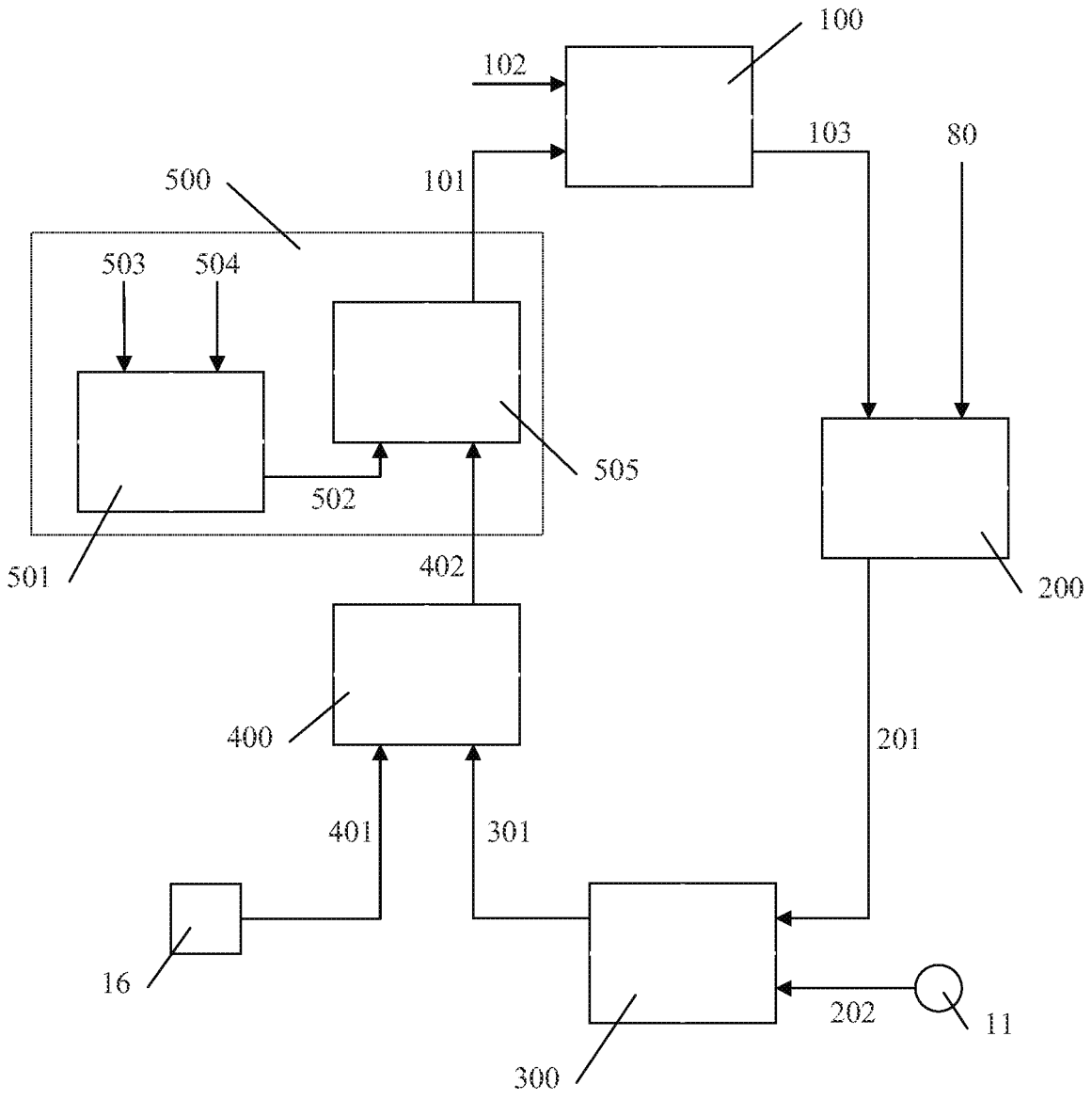
FIGS. 2 to 4 show production control loops.

FIG. 2 shows a possible arrangement of loops of the module 18 making it possible in particular to operate the production choke 9.

The loop 100 of the module 18 (called the "high level" loop) makes it possible to continuously adjust a setpoint pressure 103 in the production string according to the measured aperture 101 of the production choke and a reference aperture 102 of the production choke. The setpoint pressure 103 is continuously adjusted in so far as the value of this setpoint pressure 103 is constantly modified. This loop 100 makes it possible to adapt the value of the setpoint pressure in the production string according to the current state of the position of the production choke and the previously-assigned reference aperture. A progressive transition is obtained towards an optimized value of this setpoint pressure in the production string. Adjustment of the setpoint pressure 103 in the string makes it possible to anticipate instabilities likely to arise at the bottom of the string in order to limit their increase.

The loop 200 of the module 18 (called the "main" loop) allows continuous adjustment of the setpoint pressure 201 at the string head according to the setpoint pressure 103 in the production string 2 and according to a pressure 80 calculated or measured in the string 2. The setpoint pressure 103 is calculated by the loop 100. The setpoint pressure 201 at the string head is continuously adjusted in so far as this setpoint pressure 201 is constantly modified. The loop 200 is implemented in a cascade with respect to the loop 100 in so far as the result of the loop 100 is taken into account by the loop 200. The pressure 80 is described in greater detail below.

The loop 300 of the module 18 (called the "low level" loop) allows continuous adjustment of the aperture 301 of the hydrocarbons production choke according to the setpoint pressure 201 at the head of the production string and according to the pressure 202 measured at the head of the production string. The setpoint pressure 201 at the head of the production string is provided by the loop 200. The pressure 202 measured at the string head is supplied by the sensor 11. At the end of the loop 300, an aperture 301 of the choke 9 is obtained that is adapted so that the actual pressure at the string head approaches the setpoint pressure 201.

As the aperture of the production choke has an influence on the control of the well, the continuous adjustment, such as is carried out for example by the loop 300 makes it possible to control the well better and to anticipate its reactions. Thus it is possible to control the aperture of the choke as a function both of production targets and of the behaviour of the well at the wellhead and along the production string.

The loop 400 of the module 18 makes it possible to take account respectively the aperture 301 of the choke 9 calculated in step 300 or the aperture 401 proposed by the module 16 in order to choose an aperture 402. Preferably, the aperture 401 will be used if the latter is less than the aperture 301 for better safety of the installation.

The loop 500 of the module 18 (called the "anti-PSH loop") makes it possible to limit the aperture 401 of the production choke 9 calculated by the module 16 or the aperture 301 determined by the loop 300. Restriction of the aperture of the choke 9 is carried out according to the pressure in the hydrocarbon dispatch line downstream of the production choke 9. This loop is particularly useful for limiting the risks of overpressure.

The loop 500 comprises a step 501 which determines an aperture 502 of the choke 9 according to a pressure 503 measured in the despatch line and a reference pressure 504 in this same line. In the step 505, the aperture 502 is compared with the aperture 402 determined in step 400.

The loop 500 is well suited to the various ways of controlling the apertures of the chokes. However the loop 500 is particularly suitable for an operation in which the position of the production choke is adjusted according to a final setpoint aperture of this choke. In effect, insofar as a "final" target aperture is set, there is a risk of overpressure in the flow line downstream of the production choke 9 and deterioration of the installation. The loop 500 then allows closer monitoring of the production choke aperture.

Figure 3:
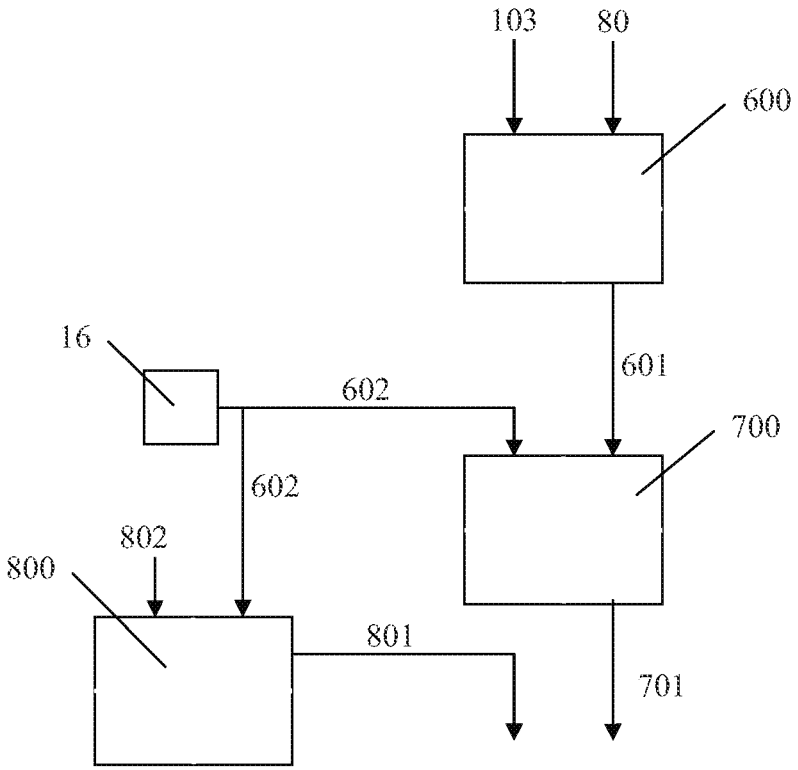

FIG. 3 shows a possible arrangement of loops of the module 18 making it possible notably to operate the gas injection choke 6.

The loop 600 of the module 18 (called "main") makes it possible to adjust a reference gas flow rate 601 according to the setpoint pressure 103 in the production string and the pressure 80 in the string. The setpoint pressure 103 is delivered by the loop 100 of FIG. 2. The loop 600 is then in a cascade in relation to the loop 100 in so far as the output of the loop 100 is used to implement the loop 600. Adjustment of the reference gas flow 601 is continuous. The loop 600 makes it possible, in the case of a reservoir producing in a discontinuous or very variable manner, to adjust the injected gas flow rate according to the pressure in the string 2. The injected gas flow rate increases when the reservoir starts production.

The loop 700 of module 18 (called "low level" loop) allows continuous adjustment of the aperture 701 of the gas injection choke 6 according to the reference gas flow rate 601 and according to a setpoint gas injection flow rate 602. The setpoint gas flow rate 602 is supplied by the module 16. This flow rate 602 is sequentially adjusted by the module 16 to progressively reach a target gas injection setpoint value. The aperture 701 of the gas injection choke is continuously adjusted so as to adapt the injection of gas in real time to the behaviour of the well.

The loop 800 of the module 18 (called the "Gas Quantity" loop) constitutes another way of adjusting the aperture of the gas injection choke 6. In effect, the loop 800 allows continuous adjustment of the aperture of the gas injection choke 6 according to the setpoint gas injection flow rate 602 and according to a gas injection flow rate 802 measured or calculated at the point of injection into the production string. The gas flow rate can be measured if the installation is equipped with a sensor. The gas flow rate can be calculated in a manner comparable with the manner described above, in relation to the pressure in the string. The setpoint gas flow rate 602 is supplied by the module 16. This flow rate 602 is sequentially adjusted by the module 16 so as to progressively reach a target gas injection setpoint value.

Figure 4:
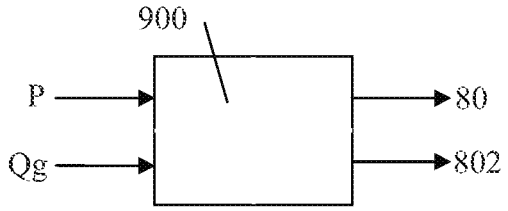

FIG. 4 shows the loop 900 of the module 18 (called "simulated sensor" loop) which makes it possible to calculate the pressure 80 in the string 2 (loops 200 and 600) and the gas flow rate 802 injected into the string 2 (loop 800). The calculation is carried out according to the pressure at the head of the space 4 and according to the injected gas flow rate at the head of the space 4. In particular, the development of the production string 2 side pressure and of the flow rate injected into the string 2 at the point of gas injection into the string 2 (valves 8) is determined This injection point can be at a level remote from the bottom of the string. This loop does not aim for an absolute value but its purpose is to supply the control module 18: presence of instability, amplitude and phasing as soon as cycles of variations begin.

The benefit of being able to calculate information relating to the pressure 80 in the string and/or the gas flow rate 802 injected into the string 2 is that such information can be obtained when the installation does not have one or more sensors in the string, or when this or these sensor(s) is(are) defective.

Nonetheless, the information relating to the pressure 80 in the string and/or the gas flow rate 802 injected into the string 2 can be directly supplied to the module 18 by sensors arranged in the string 2. The sensors are for example at the level of the valves 81, 82, 83 or even lower.

The installation can comprise different operating phases. The method can comprise a production phase during which the position of at least one of the chokes is adjusted by the cascaded control loops. FIGS. 2 to 4 show examples of control loops. These loops are cascaded in so far as the loops are carried out successively. The result of one loop is taken into account by a following loop. Due to the cascade structure, it is possible to simplify each step and thus to provide loops implemented in a simple manner. As loops are simple algorithms, this makes it possible to execute each of the loops rapidly. Moreover, the multiplication of the loops allows better account to be taken of a larger number of setpoint parameters. This allows better control of the operation of the installation. The loops are implemented for example by PIDs.

Each loop is driven according to continuously or sequentially developing setpoint parameters. The setpoint parameters are operating instructions allowing the installation to be operated. The setpoint parameters are supplied to the loops which consequently adjust the position of at least one of the chokes. The setpoint parameters can develop continuously in so far as the parameters are permanently modified. Also, the setpoint parameters can develop sequentially in so far as the parameters are modified stepwise. Generally, the development of the setpoint parameters allows control of the installation suited to the reaction of the well. The position of the chokes is adjusted in so far as the opening or closing of the chokes is suited to the operating cycle of the installation and to the reactions of the hydrocarbons well.

By way of example, the pressure in the string or at the string head can be used as a setpoint parameter. Also, the flow rate of gas injected by the gas injection choke or the gas flow rate at the gas injection point into the production string can be used as a setpoint parameter. This makes it possible to take account of what is happening both on the surface and in the well, in particular in response to actions on the surface.

In particular, during the production phase, the position of the production choke 9 is adjusted by the cascaded control loops. This makes it possible to adapt the production of the hydrocarbons well to the operating cycle of the installation. As the position of the production choke has an impact on the behaviour of the well (for example the position of the choke can have an effect on the pressure in the well), adjustment of the position of the production choke allows better control of the operation of the installation.

During the production phase, the position of the production choke 9 is continuously adjusted. This makes it possible to constantly adapt the opening or closing of the choke. Traditionally, the position of the production choke was progressively opened in a sequential manner in so far as the production choke was opened stepwise. Within each step, the position of the choke is set. The drawback of such a procedure in the production phase is that the well can exhibit a divergent behaviour that is difficult to control. In the present case, the position of the production choke 9 (opening or closing) develops continuously. This allows more precise operation of the installation.

Also, during the production phase, the position of the gas injection choke 6 is continuously adjusted by the cascaded control loops, the loops being driven according to continuously or sequentially developed instruction parameters.

The advantage of having the position of two chokes continuously adjusted by cascaded control loops, the loops being driven according to continuously or sequentially developing setpoint parameters, is that the operation of the installation can be controlled even more precisely. As the two chokes jointly have an effect on the operation of the installation, taking account of the position of both chokes further improves the production of the installation.

Among the setpoint parameters, during the production phase, the position of the production choke can moreover be adjusted by the control loops according to a final setpoint aperture of the production choke. Such an adjustment makes it possible to rapidly reach a stable hydrocarbons production rate as the increase in speed is not subject to any time lag.

Among the setpoint parameters, and during the production phase, the position of the production choke can moreover also be adjusted by the control loops according to a final setpoint aperture of the production choke that is increasing sequentially. The setpoint aperture of the production choke increases stepwise, which allows the well to reach a more stable production speed and the risks of instability to be reduced. This makes it possible to prevent the creation and amplification of instabilities at the bottom of the string 2.

In effect, a pressure variation in the string causes a fluctuation of the flow rates entering the string, and thus pressure losses in the string and consequently bottom pressure. Such instabilities cause undesirable variations of the flow rate at the wellhead, resulting in a failure to establish a stable production rate and prolongation of the startup time of the well. Uncontrolled instabilities tend to become amplified with a period correlated with the time taken for the hydrocarbons to rise in the string 2. There is a delay effect which can in certain circumstances lead to an amplification in the instability: resulting in "resonance" in the combined string-bottom reservoir feed, string-bottom gas intake, string and wellhead back-pressure. The actions on the choke at the wellhead or on the gas injection have a delayed effect on the pressure variations at the bottom.

The described loops make it possible to determine pressure and flow rate conditions in the string from the conditions measured at the surface in the space 4 and to carry out corrections on the production 9 and injection 6 chokes in order to prevent the creation and amplification of instabilities in the string 2. In particular, the loops allow a more rapid detection of the occurrence of instability and allow a more rapid correction action on the chokes 6 and 9 in the case of instability of the well. As the periodicity of these instabilities varies according to the geometry of the well, the type of fluids and the type of reservoir, the loops allow these variations to be taken into account, which allows closer production control of the well behaviour. This allows the production of the well to be improved.

During the startup phase prior to the production phase, it is preferred to give setpoints in sequential steps. In effect, this startup phase is particularly tricky as the well is then very unstable. During the startup phase, the position of the production choke 9 is sequentially adjusted. The position, as well as the control, of the production choke 9 are set during the steps, allowing the well instability to be better absorbed. In particular, this makes it possible to suitably expel potential hydrocarbons plugs. The position of the gas injection choke 6 is continuously adjusted by a control loop driven according to continuously or sequentially developing setpoint parameters. For example, a setpoint parameter can be the flow rate of gas injection into the string. This flow rate of gas injection into the string can develop sequentially in order to reach the previously described production phase in a more stable manner.

The method then passes from the startup stage to the production stage according to predetermined criteria. For example, the volume of gas injected, the duration of the startup stage or the pressure stability of the installation can be used as criteria.

Figure 5:
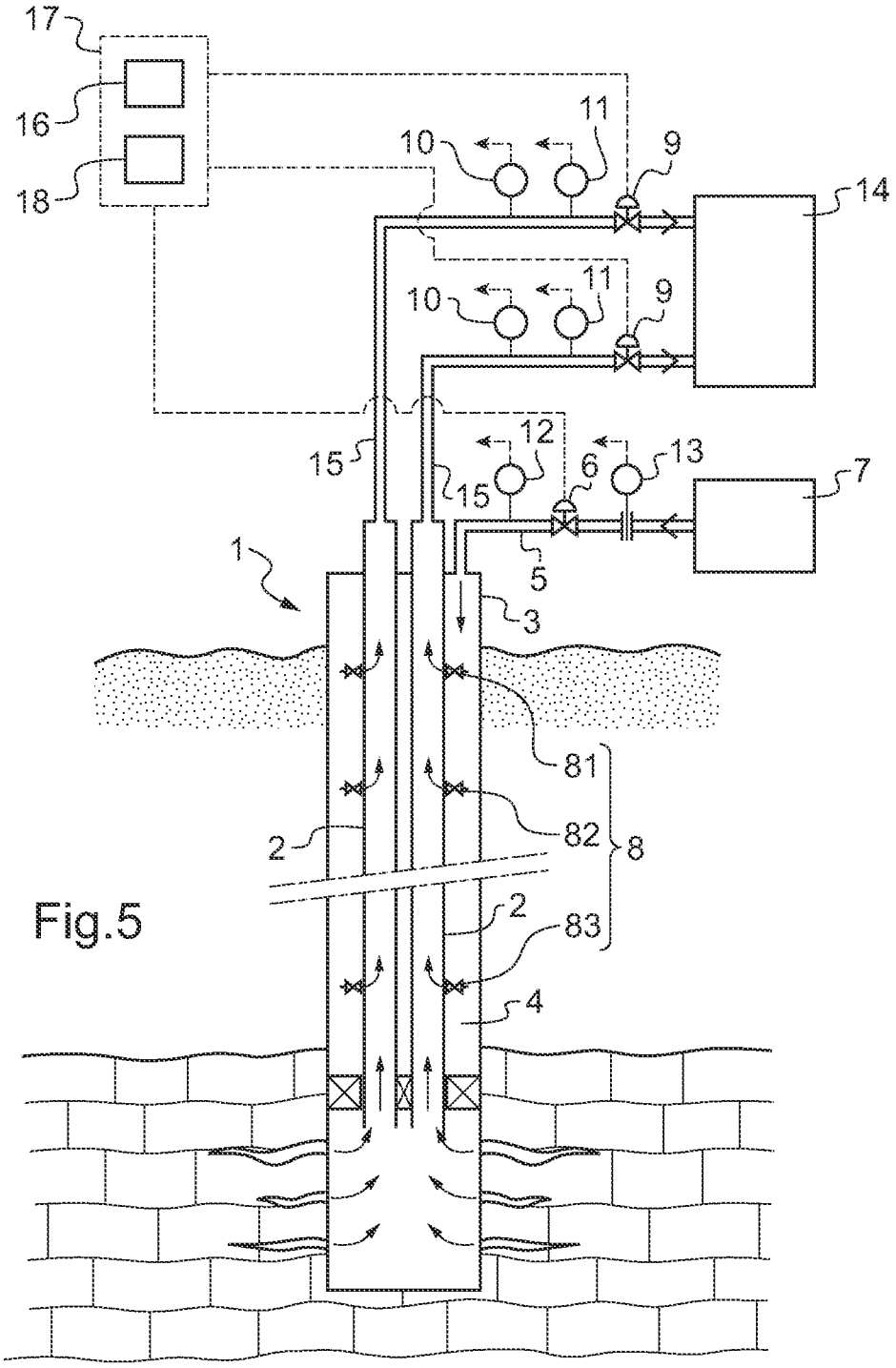
FIG. 5 shows a diagrammatic representation of an alternate production installation.

According to a variant illustrated in FIG. 5, the installation comprises a plurality of Strings 2.

The invention claimed is:

1. A method for controlling a hydrocarbons production installation, the installation comprising:

at least one hydrocarbons production string activated by a gas injection using a gas injection choke, and a production choke on the hydrocarbons production string, wherein the method comprises a production phase comprising the step of:

adjusting a position of the production choke by control loops that are carried out successively, the control loops being driven according to sequentially developing setpoint parameters, whereby the position of the production choke is adjusted by the control loops also according to a final setpoint aperture of the production choke or according to a setpoint aperture of the production choke that increases sequentially, the step of adjusting the position of the production choke comprising the steps of:

using a first loop for continuously adjusting a setpoint pressure in the production string according to a measured aperture of the production choke and of a reference aperture of the production choke;

using a second loop for continuously adjusting the setpoint pressure at a string head according to the setpoint pressure in the production string adjusted by the first loop and a pressure in the production string obtained by calculation or by measurement; and using a third loop for continuously adjusting the aperture of the production choke according to the setpoint pressure at the string head adjusted by the second loop and according to a measured pressure at the string head.

2. The method according to claim 1, wherein, the production phase further comprises the step of:

adjusting a position of the gas injection choke continuously by control loops, the loops being driven according to continuously or sequentially developing setpoint parameters.

3. The method according to claim 1, wherein the method further comprises, prior to the production phase, a startup phase comprising the steps of:

adjusting a position of the production choke sequentially; and adjusting the position of the gas injection choke continuously by a control loop driven according to a setpoint parameter developing continuously or sequentially.

4. The method according to claim 1, wherein the method further comprises a step of:

driving the loops also according to parameters measured on the installation or calculated.

5. The method according to claim 1, wherein the method further comprises:

choosing setpoint parameters from a group consisting of the pressure at the head of the hydrocarbons production string, the pressure in the hydrocarbons production string, the pressure at the top of the injection string, the flow rate of gas injected by the gas injection choke and the gas flow rate at the point of gas injection into the hydrocarbons production string.

6. The method according to claim 1, wherein the method further comprises using a loop for:

adjusting a reference gas flow rate according to the setpoint pressure at a point of gas injection into the production string and of a pressure in the string obtained by calculation or by measurement.

7. The method according to claim 6, wherein the method further comprises using a loop for continuously:

adjusting an aperture of the gas injection choke according to the reference gas flow rate and according to a setpoint gas flow rate.

8. The method according to claim 1, wherein the method further comprises a step of:

adjusting a position of the gas injection choke by the control loops also according to a setpoint gas flow rate at a point of gas injection into the production string, the setpoint gas flow rate at the point of gas injection into the production string increasing sequentially.

9. The method according to claim 8, wherein the method further comprises using a loop for continuously:

adjusting an aperture of the gas injection choke according to the setpoint gas flow rate and according to the gas flow rate measured or calculated at the point of gas injection into the production string.

10. The method according to claim 1, wherein the method further comprises using a loop for:

adjusting a maximum setpoint aperture of the production choke according to a measured pressure downstream of the production choke and of a reference pressure downstream of the production choke.

11. The method according to claim 1, wherein the method further comprises using a loop for:

adjusting a maximum setpoint aperture of the production choke according to a measured pressure downstream of the production choke and of a reference pressure downstream of the production choke.

12. The method according to claim 11, wherein the method further comprises a step of:

opening the production choke according to a smallest aperture between the maximum setpoint aperture and an aperture obtained in the loop for continuously adjusting the aperture of the production choke.

13. The method according to claim 1, wherein the installation comprises a plurality of strings.

* * * * *